United States Patent [19]

Wert et al.

[11] Patent Number: 4,853,181

[45] Date of Patent: Aug. 1, 1989

[54] HOT WORK TOOL STEEL

[76] Inventors: David E. Wert, 304 Raymond St., Hyde Park, Reading, Pa. 19605; Raymond M. Hemphill, 813 Evergreen Dr., Wyomissing, Pa. 19610

[21] Appl. No.: 875,648

[22] Filed: Jun. 18, 1986

[51] Int. Cl.[4] ..... C22C 38/22; C22C 38/24

[52] U.S. Cl. ..... 420/111; 420/105

[58] Field of Search ..... 420/111, 105

[56] References Cited

U.S. PATENT DOCUMENTS

| | | | |
|---|---|---|---|
| 1,468,937 | 9/1923 | Armstrong | 420/104 |
| 1,496,979 | 6/1924 | Corning et al. | 420/105 |
| 1,496,980 | 6/1924 | Armstrong | 420/105 |
| 1,775,615 | 6/1930 | Succop | 420/111 |
| 1,835,151 | 12/1931 | Fry | 420/105 |
| 1,937,334 | 11/1933 | Emmons | 420/105 |
| 1,938,221 | 12/1933 | Gill | 420/105 |
| 2,132,877 | 10/1938 | Naumann | 420/105 |
| 2,147,119 | 2/1939 | Emmons | 420/105 |
| 2,188,138 | 11/1938 | Malcolm | 420/111 |
| 2,198,476 | 4/1940 | Emmons | 420/105 |
| 2,241,187 | 5/1941 | DeVries | 420/105 |
| 2,289,449 | 7/1942 | Nelson | 420/105 |
| 2,331,899 | 10/1943 | Finkl | 420/105 |
| 2,347,375 | 4/1944 | Stargardier | 420/105 |
| 2,645,574 | 7/1953 | Clark | 420/105 |
| 2,780,570 | 2/1957 | Riedel | 420/105 |
| 2,857,267 | 10/1958 | Demirjian | 420/113 |
| 2,861,908 | 11/1958 | Mickelson et al. | 420/108 |
| 2,876,095 | 3/1959 | Dickerson | 420/109 |
| 2,968,549 | 1/1961 | Brady et al. | 420/109 |
| 3,092,491 | 6/1963 | Payson et al. | 420/109 |
| 3,128,175 | 4/1964 | Nagy et al. | 420/105 |
| 3,163,525 | 12/1964 | Fletcher | 420/105 |
| 3,295,966 | 1/1967 | Steven | 420/105 |
| 3,431,101 | 3/1969 | Kunitake et al. | 420/105 |
| 3,640,114 | 6/1969 | Foley, Jr. | 420/105 |
| 3,712,808 | 1/1973 | Phillip | 420/108 |
| 3,912,553 | 10/1975 | Waid et al. | 420/109 |
| 4,058,650 | 11/1977 | Kiyonaga et al. | 420/111 |
| 4,171,233 | 10/1979 | VanderVoort | 420/109 |

OTHER PUBLICATIONS

Excerpt from ASM Metals Handbook, vol. 3, p. 437 (9th Ed., 12/80).

Carpenter Technology Technical Data Sheet, "Carpenter", No. 883 (3/80).

*Primary Examiner*—Deborah Yee

[57] ABSTRACT

A hot work tool steel has high hardness capability and improved toughness when air cooled in section sizes of 6 inches (15.24 cm) or larger. The alloy steel which is deep air hardenable, has good dimensional stability and exceptional wear resistance, in its broad scope consists essentially of about 0.35–0.6 w/o carbon, 1.0 w/o max. manganese, 2.0 w/o max. silicon, 5.7–7.0 w/o chromium, 1.65–2.2 w/o molybdenum, 0.6–1.1 w/o vanadium, and the balance is iron except for the usual impurities found in commercial grades of such alloy steels.

10 Claims, No Drawings

HOT WORK TOOL STEEL

BACKGROUND OF THE INVENTION

This invention relates to tool steels and, more particularly, to a hot work tool steel having improved wear resistance, and toughness, as well as good temper resistance, tensile properties and dimensional stability.

Hitherto, a hot work tool steel designated as AISI Type H13 has been extensively used in the aluminum extrusion industry to provide mandrels and dies for use at temperatures in the range of 700–1000 F. (370–540 C.). Type H13 alloy steel has the following composition in weight percent (w/o). Here and throughout this application, percent will be by weight unless otherwise indicated.

| | w/o |
|---|---|
| C | 0.32–0.45 |
| Mn | 0.20–0.50 |
| Si | 0.80–1.20 |
| Cr | 4.75–5.50 |
| Mo | 1.10–1.75 |
| V | 0.80–1.20 |
| Fe | Bal. |

Included with the balance (Bal.) are the usual incidental amounts of other elements present in commercial grades of tool and die steels.

Type H13 is nominally designated as a 5 Cr hot work die steel and is noted for its toughness and wear resistance. Its other properties include good temper resistance, and high hardness and strength at the above-mentioned elevated temperatures. It is deep hardening, can be hardened in large sections by air cooling, and can be heat treated to an ultimate tensile strength of up to about 300 ksi (2070 MPa). However, because of its tendency to undergo a substantial loss of toughness as measured by the Charpy V-notch impat test when members of large section size are air cooled, Type H13 leaves much to be desired. Charpy V-notch impact values of less than about 2 ft-lb (about 2.7 J) in the longitudinal direction are usual for air cooled type H13 members of large section size, that is, section sizes of six inches and larger.

SUMMARY OF THE INVENTION

It is, therefore, a principal object of this invention to provide a tool steel having significantly improved room temperature toughness when air cooled in large sections while its remaining physical properties are at least comparable to type H13 alloy.

Another object is to provide such an alloy which not only has better toughness than H13 alloy when air cooled following heat treatment but also has better wear resistance.

A further object is to provide such an alloy having better temper resistance, wear resistance, and toughness when air cooled in large section sizes, while the remaining properties, including hardness and strength, are at least comparable to type H13 alloy.

The foregoing objects, as well as additional advantages of this invention, are achieved to a significant measure by providing a tool steel having the broad composition and fully achieved by providing a tool steel having the preferred composition as follows.

| | Broad (w/o) | Preferred w/o |
|---|---|---|
| Carbon | 0.35–0.6 | 0.42–0.5 |
| Manganese | 1.0 Max | 0.35–0.6 |
| Silicon | 2.0 Max | 0.8–1.2 |
| Chromium | 5.7–7.0 | 5.8–6.2 |
| Molybdenum | 1.65–2.2 | 1.85–1.95 |
| Vanadium | 0.6–1.1 | 0.7–0.9 |

The remainder of the alloy is iron except for the usual mpurities found in commercial grades of such steels which may vary from a few hundredths of a percent as in the case of phosphorus or sulphur to larger amounts of other elements which do not objectionably detract from the desired properties of the composition. Thus, up to about 0.025 w/o each of phosphorus and sulphur may be present although each is preferably limited to no more than about 0.005 w/o. However, when desired free machining additives, such as up to about 0.10 w/o sulfur, are included to improve machinability. It is not intended by the broad and preferred ranges indicated above to restrict the ranges by presenting them in tabular form for ready reference. It is contemplated that when desired any one or more of the preferred ranges indicated for one or more elements can be used with one or more of the broad ranges indicated for remaining elements. Furthermore, the minimum or maximum amount indicated as defining the broad range of one or more elements can be used with the maximum or minimum amount indicated as defining a preferred range for one or more corresponding elements.

DETAILED DESCRIPTION

A minimum of about 0.35 w/o carbon is required in this composition to provide the desired wear resistance and an attainable hardness on the Rockwell C Scale (RC) of about 48 when heat treated. Above about 0.6 w/o carbon, the toughness of the composition tends to decrease such that toughness in the longitudinal direction of at least about 6 ft-lb (about 8.1 J), as measured by the Charpy V-notch impact test, is not attainable. To ensure the attainment or the desired hardness and toughness, preferably about 0.42–0.50 w/o, better yet about 0.42–0.46 w/o carbon is present in this composition.

Manganese contributes to the deep air hardenability of this composition in large sections, e.g., to a depth of 6 inches or more. Up to about 1 w/o manganese can be present but is not considered an essential element for section sizes less than about 6 inches (15.24 cm) in major cross-sectional dimension. For section sizes of about 6 inches (15.24 cm) or more a minimum of about 0.35 up to about 0.60 w/o manganese is preferred. For best results about 0.42–0.48 w/o manganese is present in this composition.

Up to about 2 w/o silicon can be present in this alloy. When present, silicon contributes to the hardenability of this composition and more importantly, ensures a good secondary hardening response. Preferably at least 0.5 w/o, better yet about 0.8 w/o, silicon is present. Silicon is a strong ferrite former, however, and it is preferably limited to about 1.2 w/o. Best results are attained with about 0.95–1.05 w/o silicon.

Chromium most importantly contributes to the deep air hardenability of this composition and permits the attainment of the good toughness characteristic of this alloy in large section sizes. Chromium also has a beneficial effect on the oxidation resistance of this composition. Excessive chromium adversely affects the temper resistance, i.e. the as-tempered hardness, of this composition. Also, excessive chromium tends to promote retention of austenite during quenching. Therefore, about 5.7–7.0 w/o, preferably 5.8–6.2 w/o, chromium is present in this composition. About 5.95–6.05 w/o chromium is preferred for best results.

Molybdenum helps to increase the hardness capability, i.e. peak attainable hardness, of the composition. It also adds to the temper resistance and hardenability of the alloy. Furthermore, molybdenum tends to lower the coefficient of thermal expansion of the composition which is beneficial to the thermal fatigue behavior resulting from thermal cycling. Therefore, at least about 1.65 w/o, better yet about 1.8 w/o molybdenum is present. Above about 2.2 w/o, however, the increase in the cost of the alloy outweighs the beneficial effects of molybdenum. About 1.85–1.95 w/o molybdenum is preferred for best results.

Vanadium also contributes to the temper resistance and secondary hardening response of this composition. It adds wear resistance by forming vanadium carbides which also function to help maintain a relatively small grain structure and thereby contribute to the alloy's touchness. Accordingly, at least about 0.6 w/o preferably about 0.7 w/o, vanadium is required to obtain the temper resistance and wear resistance characteristic of this alloy. Excessive vanadium, however, tends to tie up too much carbon thereby leading to reduced hardness capability in the as-tempered condition, no more than about 1.1 w/o, preferably no more than about 0.9 w/o, vanadium is present. For best results about 0.77–0.83 w/o vanadium is preferred.

For improved machinability up to about 0.10 w/o sulfur may be included if desired or an equivalent amount of one or more other well known free machining additives to tool and die steels.

This alloy does not require any unusual preparation and may be made using conventional, well known techniques. The preferred commercial practice is to prepare a heat using the electric arc furnace, refine it using the known argon-oxygen decarburization (AOD) practice and then cast the heat in the form of electrodes. The electrodes are then remelted in an electroslag remelting (ESR) furnace and recast into ingots or other desired form. For good results parts can be readily forged from a furnace temperature of about 1900–2100 F. (about 1035–1150 C.) and air cooled. Annealing or stress relieving may be carried out by heating to about 1550–1650 F. (about 850–900 C.) for up to about 10 hours, depending upon the size of the part, cooling slowly in the furnace at the rate of about 10–20 F.° (about 5–10 C.°) per hour to about 1100 F. (about 595 C.) followed by cooling in air. Hardening is readily carried out by heating to the desired austenitizing temperature, generally between about 1875 F. and 1950 F. (about 1025–1065 C.), but preferably about 1925 F. (about 1050 C.) followed by quenching. It is a particular advantage of this alloy that it can be and is preferably quenched from the austenitizing temperature by cooling in air in sections of 6 inches (15.24 cm) or larger in major cross-sectional dimension. Tempering is preferably carried out by holding at about 1100 F. (about 595 C.) for 2 hours +2 hours (two successive heat treatments each of two hour duration). When thus hardened and tempered the attainable hardness of this composition in air cooled large section sizes is about RC 48 and Charpy V-notch (longitudinal) toughness is at least about 7 ft-lb (about 9.5 J). The composition as thus heat treated is suitable for use in metal forming tools such as dies, mandrels and others.

As an example of the present invention, a 300 lb (136 kg) vacuum induction melted heat having the composition in weight percent shown in Table I was prepared and cast into a 7½ inch (19 cm) square ingot.

TABLE I

| | Ex. 1 |
|---|---|
| C | 0.44 |
| Mn | 0.44 |
| Si | 0.97 |
| P | 0.005 |
| S | 0.003 |
| Cr | 5.98 |
| Ni | 0.01 |
| Mo | 1.92 |
| V | 0.83 |
| W | 0.013 |
| Fe | Bal. |

The ingot was vermiculite cooled, stress relieved at 1350 F. (732 C.), and then air cooled. A 3½ inch (8.9 cm) long piece was cut from the stress relieved ingot and forged to a 2½ inch (6.4 cm) square bar. The bar was vermiculite cooled, stress relieved at 1400 F. (760 C.) for 2 hours and air cooled. The bar was annealed at about 1550 F. (850 C.) for 10 hours and then furnace cooled at 20 F.° (11.1 C.°) per hour. The hardness of the annealed bar was 88.5 on the Rockwell B scale, (HRB).

Cube samples ½ inch (1.27 cm) on a side were cut from the annealed billet. Individual samples were austenitized in salt for 25 minutes at the respective temperatures indicated in Table II and then vermiculite cooled. The hardness of each of the as-quenched samples was then measured.

The as-quenched cube samples were then tempered at 1000 F. (538 C. ) for 2 hours plus 2 hours after which hardnesses were again measured. The as-quenched and as-tempered hardnesses for each sample are shown in Table II together with the measured grain size. Hardness values are given as Rockwell C (HRC) scale. To determine grain size as a function of austenitizing temperature additional ½ inch (1.27 cm) cube samples were austenitized in salt for 25 minutes at the respective temperature indicated in Table II. The samples were then quenched in salt at 1350 F. (732 C.) and held for 30 minutes in order to provide greater definition of the grain boundaries by precipitating carbides. After the quenching step the samples were air cooled. Grain sizes were rated using the Snyder-Graff method.

TABLE II

| Aust. Temp. F.(C.) | As-quenched HRC | Grain Size | As-tempered HRC |
|---|---|---|---|
| 1850 (1010) | 54.5 | * | 54.5 |
| 1900 (1038) | 57.5 | 10 | 57.5 |
| 1950 (1066) | 59.5 | 8 | 59.0 |
| 2000 (1093) | 60.0 | 4 | 59.0 |

*Unratable. Grain boundaries not discernible when hardened at this temperature.

Table II verifies that austenitizing is best carried out in the range of about 1875–1950 F. (about 1025–1065 C.) in order to limit grain growth to an acceptable level. The close correlation between the tempered hardness and the as-quenched hardness reflects the absence of a deleterious amount of retained austenite in the quenched material.

A tempering survey was performed to evaluate the temper-resistance and secondary hardening response of the composition. Additional cube samples were cut from the annealed bar, austenitized in salt for 25 minutes at 1925 F. (1052 C.) and vermiculite cooled. The samples were then tempered as shown in Table III. The as-tempered hardnesses indicated in Table III for each sample are given as HRC. The samples had an average as-quenched hardness of 57.0 HRC.

TABLE III

| Tempering Temp. F.(C.) | HRC @ 2 hr | HRC @ 2 hr + 2 hr |
|---|---|---|
| 900 (482.2) | 57.5 | 59.0 |
| 1000 (537.8) | 58.0 | 57.5 |
| 1050 (565.6) | 56.5 | 55.5 |
| 1100 (593.3) | 54.0 | 51.0 |
| 1150 (621.1) | 47.0 | 42.5 |
| 1200 (648.9) | 39.0 | 34.5 |
| 1300 (704.4) | 29.0 | 28.0 |

The good temper resistance of this alloy when exposed to temperatures up to about 1100 F. (about 593 C.), as shown by Table III, indicates the alloy is suitable for use in hot work die applications where exposure to elevated temperatures, up to about 1100 F. (about 593 C.) are encountered. It can also be seen from Table III that the alloy exhibits good secondary hardening at about 900 to 1000 F. (about 480 to 540 C.).

Longitudinal and transverse (L/T) Charpy V-notch impact specimens cut from the annealed 2½ inch bar were austenitized in salt for 25 minutes at 1925 F. (1052 C.) and air or vermiculite cooled. The vermiculite cooled specimens were austenitized and quenched in six packs to simulate the cooling rate obtained in air cooling a 6 inch (15.2 cm) round bar. Duplicates of both the longitudinal and transverse specimens were tempered at 1000 F. (538 C.), 1100 F. (593 C.), and 1150 F. (621 C.) respectively for 2 hours plus 2 hours. Impact energy values were determined at both room temperature and at 800 F. (427 C.) as shown in Table IV under "CVN". Hardness values were obtained on the broken specimens and are given in Table IV as HRC.

TABLE IV

| Air Cool | | | | | |
|---|---|---|---|---|---|
| | | Longitudinal | | Transverse | |
| Temp. F.(C.) | Temper F.(C.) | CVN ft-lb (J) | HRC | CVN ft-lb (J) | HRC |
| R.T. | 1000 (538) | 6.7,7.7 (9.1,10.4) | 58.0 | 3.2,2.4 (4.3,3.3) | 58.0 |
| | 1100 (593) | 12.5,11.8 (16.9,16.0) | 50.0 | 2.0,4.7 (2.7,6.4) | 50.5 |
| | 1150 (621) | 15.1,13.0 (20.5,17.6) | 43.5 | 4.5,6.5 (6.1,8.8) | 43.0 |
| 800 (427) | 1000 (538) | 14,14 (19.0,19.0) | 57.0 | 6,6 (8.1,8.1) | 57.0 |
| | 1100 (593) | 24,21 (32.5,28.5) | 49.0 | 6,13 (8.1,17.6) | 49.5 |
| | 1150 (621) | 45,49 (61.0,66.4) | 42.0 | 11,8 (14.9,10.8) | 42.5 |
| Vermiculite Cool | | | | | |
| R.T. | 1000 (538) | 5.3,4.2 (7.2,5.7) | 58.5 | 1.9,2.3 (2.6,3.1) | 58.5 |
| | 1100 (593) | 8.8,8.3 (11.9,11.3) | 50.0 | 2.5,3.5 (3.4,4.7) | 50.0 |
| | 1150 (621) | 10.8,11.7 (14.6,15.9) | 42.0 | 3.6,7.3 (4.9,9.9) | 42.0 |
| 800 (427) | 1000 (538) | 11,11 (14.9,14.9) | 57.5 | 4,4 (5.4,5.4) | 57.5 |
| | 1100 (593) | 15,14 (20.3,19.0) | 49.5 | 6,6 (8.1,8.1) | 49.5 |
| | 1150 (621) | 37,39 (50.2,52.9) | 42.5 | 19,16 (25.8,21.7) | 42.0 |

Table IV shows the combination of good toughness and high hardness achieved by the present alloy when heat treated with conventional methods. The data for the vermiculite cooled specimens also indicates that there is no significant difference in the toughness of the material when air cooled in large section sizes than would be obtained with a faster quenching method.

Wear test coupons 3 inch (7.6 cm) by 1 inch (2.54 cm) by ¼ inch (0.64 cm) machined from the annealed bar were austenitized in salt for 25 minutes at 1925 F. (1052 C.), vermiculite cooled, and then tempered at 1000 F. (538 C.), 1100 F. (593 C.), and 1150 F. (621 C.) respectively for 2 hours plus 2 hours. All of the wear test coupons were austenitized and quenched in three-packs to simulate the cooling rate obtained when air cooling a 6 inch (15.2 cm) round. Wear testing was carried out in accordance with ASTM Test G 65, Method A. The wear test results are shown in Table V as the volume of lost material (Vol. Loss). Hardness values taken on all samples after testing are also given in Table V as HRC.

TABLE V

| Temper. F.(C.) | HRC | Vol. Loss ($mm^3$) | Avg. |
|---|---|---|---|
| 1000 (538) | 58.0 | 112.4,110.3 | 111.4 |
| 1100 (593) | 50.5 | 116.9,111.7 | 114.3 |
| 1150 (621) | 42.0 | 142.7,144.3 | 143,5 |

Table V shows the good wear resistance of the present alloy when tempered up to about 1100 F. (about 593 C.).

Longitudinal tensile specimens 2 inch (5.08 cm) long, each having a diameter of 0.252 in (64 mm) were machined from the annealed 2½ inch square (6.35 cm) bar. The tensile specimens were austenitized in salt for 25 minutes at 1925 F. (1052 C.), air cooled, and then tempered at 1100 F. (593 C.) for 2 hours plus 2 hours. The tensile specimens were pulled at room temperature and at 800 F. (427 C.). The results of the tensile tests are shown in Table VI, including the 0.2% (4 Diam.) yield strength (0.2% Y.S.), and the ultimate tensile strength (U.T.S.) in ksi ($MN/m^2$), as well as the percent elongation (El.%) and reduction in area (R.A.%). Hardnesses were measured on each sample after testing and are given as HRC.

TABLE VI

| Temp. F.(C.) | 0.2% Y.S ksi ($MN/m^2$) | U.T.S. ksi ($MN/m^2$) | El. (%) | R.A. (%) | HRC |
|---|---|---|---|---|---|
| R.T. | * | 259.1 (1787.4) | 7.4 | 38.6 | 51.5 |
| | 231.2 | 259.4 | 6.7 | 34.8 | 51.5 |

TABLE VI-continued

| Temp. F.(C.) | 0.2% Y.S ksi (MN/m²) | U.T.S. ksi (MN/m²) | El. (%) | R.A. (%) | HRC |
|---|---|---|---|---|---|
| | (1594.9) | (1789.4) | | | |
| 800 | * | 208.7 | 13.9 | 56.9 | 50.0 |
| (427) | | (1439.7) | | | |
| | 195.9 | 220.0 | 15.7 | 56.3 | 50.0 |
| | (1351.4) | (1517.6) | | | |

*Value not determined.

Table VI illustrates the good strength achieved by the present alloy at room and elevated temperatures.

For purposes of comparison, a heat of the alloy of the present invention, Example 2, and two heats of AISI type H13 alloy, Alloy A and Alloy B, were electric arc melted, argon oxygen decarburized and cast into electrodes. The as-cast electrodes were each furnace cooled by placing them in a furnace, holding at 1436 F. (780 C.) for 48 hours, then shutting off the furnace and allowing them to cool. After cooling, the electrodes were electroslag remelted and cast into ingots which were then double furnace cooled using the above described furnace cooling process. The compositions of Example 2, Alloy A and Alloy B are given in weight percent in Table VIII.

TABLE VII

| | Ex. 2 | Alloy A | Alloy B |
|---|---|---|---|
| C | 0.46 | 0.39 | 0.40 |
| Mn | 0.46 | 0.31 | 0.30 |
| Si | 1.04 | 0.99 | 1.03 |
| P | 0.012 | 0.019 | 0.013 |
| S | 0.001 | 0.001 | 0.002 |
| Cr | 6.00 | 5.16 | 5.18 |
| Mo | 1.90 | 1.31 | 1.31 |
| V | 0.83 | 1.00 | 1.06 |
| Fe | Bal. | Bal. | Bal. |

Included with the balance (Bal.) are the usual incidental amounts of the elements, for example Ni, Cu, Co, N, Ti, Cb, and W, present in commercial grades of tool and die steels but which have no significant effect on the mechanical properties of such steels.

The remelted ingot of Example 2, after cooling, was homogenized at 2150 F. (1177 C.) for 24 hours and then furnace cooled to about 2075 F. (about 1135 C.). The ingot was hot worked from 2075 F. (1135 C.) to a diameter of 9.9 inch (25.24 cm), air cooled to about 800 F. (about 427 C.) and then furnace cooled as before followed by annealing. Annealing was carried out by heating at 1616 F. (880 C.) for 48 hours and then furnace cooling at the rate of 20 F.° (about 11 C.°) per hour down to 1100 F. (593 C.), followed by cooling in air. When the billet was thus cooled, it was machined to 9½ inch (24.1 cm) round.

The remelted ingot of Alloy A was homogenized at 2150 F. (1177 C.) for 24 hours and then hot worked from 2150 F. (1177 C.) to a 13.2 inch (33.5 cm) square billet. The billet was normalized at 1975 F. (1079 C.) for 4 hours and then air cooled. Following the normalizing heat treatment, the billet was annealed at 1616 F. (880 C.) similarly to the billet of Example 2. After annealing the billet was machined to 12 inch (30.5 cm) square.

The remelted ingot of Alloy B was processed similarly to that of Alloy A except that it was hot worked to a rectangular 11-13/16 inch (30.0 cm) by 6-13/16 inch (17.3 cm) billet and, after normalizing and annealing heat treatments, machined to 11½ inch (29.2 cm) by 6½ inch (16.5 cm). It is to be noted that the differences in heat treating between Alloys A and B and Example 2 are not considered to have any significant effect on the mechanical properties of the material.

Longitudinal and transverse Charpy V-notch impact specimens were cut from the 9½ inch (24.13 cm) round billet of Example 2 and wired together in packs of six. The six-packs were austenitized in salt at 1925 F. (1052 C.) for 25 minutes and then vermiculite cooled. This procedure simulates he air cooling of a 6 inch (about 15.2 cm) round section of the composition. The six-packs of Example 2 specimens were then tempered at 1100 F. (593 C.) for 2 hours plus 2 hours. After heat treating, all of the Example 2 specimens were finish machined and notched.

Longitudinal and transverse Charpy V-notch impact specimens were cut from the 12 inch (30.5 cm) square billet of Alloy A. The specimens were austenitized at 1875 F. (1025 C.), the preferred austenitizing temperature for H13 type alloys, in argon for 50 minutes followed by oven cooling in an argon atmosphere according to the following program as a simulation of cooling a 6 inch (15.2 cm) section in air: 1875 F.-1400 F. (1025 C.-760 C.) in 10 minutes; 1400 F.-960 F. (760 C.-516 C.) in 20 minutes; 960 F.-730 F. (516 C.-388 C.) in 30 minutes; 730 F.-200 F. (388 C.-93 C.) in 2.85 hours. The specimens were then removed from the argon atmosphere and cooled in air to room temperature. After cooling, the specimens were tempered at 1100 F. (593 C.) for 2 hours plus 2 hours. It is to be noted that the different cooling methods employed for Alloy A and Example 2 provide the same effective cooling rate for all practical purposes.

The results of the Charpy V-notch impact tests for each of three longitudinal and transverse specimens (L/T) are shown in Table VIII under "CVN". Hardness values were obtained on the broken specimens and the average values for each set of specimens are given in Table VIII as HRC.

TABLE VIII

| | Example 2 | | Alloy A | |
|---|---|---|---|---|
| L/T | HRC | CVN ft-lb (J) | HRC | CVN ft-lb (J) |
| L | 49.0 | 7.7,7.4,7.2 (10.4,10.0,9.8) | 50.3 | 1.5,1.3,1.9 (2.0,1.8,2.6) |
| T | 49.5 | 4.0,4.5,2.5 (5.4,6.1,3.4) | 50.2 | 2.0,2.1,1.8 (2.7,2.8,2.4) |

Table VIII shows the significant improvement in toughness achieved by the present alloy over the H13 alloy.

Additional longitudinal and transverse specimens (L/T) of Example 2 and of Alloy B were machined into wear test coupons measuring 1 inch (2.54 cm) by 3 inch (7.62 cm) by ½ inch (1.27 cm). The coupons of Example 2 were austenitized at 1925 F. (1052 C.) for 25 minutes, vermiculite cooled, and then tempered at the respective temperatures indicated in Table IX for 2 hours plus 2 hours. The coupons of Alloy B were austenitized at 1875 F. (1025 C.) in salt for 25 minutes, vermiculite cooled, and then tempered at the temperatures indicated in Table IX for 2 hours plus 2 hours. The coupons of both materials were austenitized and quenched in three-packs to simulate the cooling rate obtained when air cooling a 6 inch (15.24 cm) round section. Wear testing was carried out in accordance with ASTM Standard Test G65, Method A. The wear test results for each of duplicate coupons are shown in Table IX. A smaller volume loss value indicates greater wear resistance of the material. Hardness measurements, given under HRC in Table IX, were taken on each coupon after testing.

TABLE IX

| L/T | Temper F.(C.) | Example 2 HRC | Example 2 Vol. Loss ($mm^3$) | Alloy B HRC | Alloy B Vol. Loss ($mm^3$) |
|---|---|---|---|---|---|
| L | 1000 (537.8) | 58.5 | 118.5,114.1 | 52.5 | 123.6,130.0 |
| | 1100 (593.3) | 49.0 | 128.0,119.0 | 47.0 | 131.3,132.4 |
| T | 1000 (537.8) | 58.0 | 125.0,124.2 | 52.5 | 128.9,118.7 |
| | 1100 (593.3) | 47.5 | 134.7,144.0 | 47.0 | 136.6,141.3 |

Table IX demonstrates that the present alloy has significantly better wear resistance in the longitudinal direction than the H13 alloy and is at least as good as H13 in the transverse direction.

Longitudinal tensile test specimens 2 inch (5.08 cm) long having 0.252 inch (0.64 cm) diameters were machined from the billets of Example 2 and Alloy B. The tensile specimens of Example 2 were austenitized in salt at 1925 F. (1052 C.) for 25 minutes and cooled in air. The tensile specimens of Alloy B were austenitized in salt at 1875 F. (1025 C.) for 25 minutes and also cooled in air. Because the optimum austenitizing temperature for type H13 alloy is 1875 F. (1025 C.) the H13 alloy specimens were austenitized at 1875 F. All the specimens were tempered at 1000 F. (538 C.), 1100 F. (593 C.), and 1150 F. (621 C.) respectively for 2 hours plus 2 hours. The results of the tensile tests at room temperature, including the 0.2% (4 Diam.) yield strength (0.2% Y.S.) and the ultimate tensile strength (U.T.S.) given in ksi ($MN/m^2$), as well as the percent elongation (El.%) and reduction in area (R.A.%), of both Example 2 and Alloy B are shown in Table X below. Hardness measurements given in Table X under HRC, were taken on all specimens after testing.

TABLE X

| Temper F.(C.) | 0.2% Y.S. ksi ($MN/m^2$) | U.T.S ksi ($MN/m^2$) | El. (%) | R.A. (%) | HRC |
|---|---|---|---|---|---|
| Example 2 | | | | | |
| 1000 (537.8) | — — | 344.2 (2373.2) | 8.6 | 19.7 | 58.0 |
| | 287.4 (1981.6) | 347.7 (2397.3) | 7.0 | 28.1 | |
| | 286.8 (1977.4) | 347.1 (2393.2) | 7.8 | 34.9 | |
| 1100 (593.3) | 220.4 (1519.6) | 254.5 (1754.7) | 9.5 | 33.1 | 49.0 |
| | 227.2 (1566.5) | 257.7 (1776.8) | 8.2 | 31.2 | |
| | 228.5 (1575.5) | 260.3 (1794.7) | 9.6 | 30.5 | |
| 1150 (621.1) | 168.3 (1160.4) | 201.4 (1388.6) | 12.8 | 40.1 | 40.5 |
| | 165.7 (1142.5) | 201.6 (1390.0) | 14.0 | 44.5 | |
| | 167.7 (1156.3) | 200.8 (1384.5) | 12.9 | 44.5 | |
| Alloy B | | | | | |
| 1000 (537.8) | 229.6 (1583.0) | 283.7 (1956.1) | 7.7 | 28.5 | 52.5 |
| | 231.8 (1598.2) | 282.9 (1950.5) | 8.1 | 33.3 | |
| | 5.0 (1551.3) | 281.9 (1943.6) | 8.3 | 29.3 | |
| 1100 (593.3) | 204.9 (1412.7) | 229.6 (1583.0) | 10.1 | 41.6 | 48.0 |
| | 203.3 (1401.7) | 229.8 (1584.4) | 9.2 | 36.3 | |
| | 201.7 (1390.7) | 231.2 (1594.1) | 10.5 | 40.8 | |
| 1150 (621.1) | 162.8 (1122.5) | 184.9 (1274.8) | 12.7 | 49.0 | 40.5 |
| | 160.8 (1108.7) | 182.3 (1256.9) | 12.5 | 46.8 | |
| | 164.3 (1132.8) | 183.8 (1267.3) | 12.5 | 48.8 | |

Table X shows that the alloy according to this invention has a better combination of ductility and strength than type H13 tool steel.

The alloy of the present invention is well suited for making tools and other articles for use in hot work applications, including dies and mandrels for extrusion of materials such as aluminum. The alloy has excellent hardness and strength and significantly better toughness and wear resistance than AISI type H13 tool steel when air cooled in section sizes of 6 inch (15.24 cm) and larger. The alloy of the present invention should therefore be more economical to use than H13 since the improved toughness and wear resistance would tend to prolong the life of tools and other articles formed from the alloy.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention claimed.

What is claimed is:

1. A deep air hardenable alloy steel having a high hardness capability, improved room temperature toughness when air cooled in large section sizes, good temper resistance up to 1100° F., and exceptional wear resistance, said alloy steel, in weight percent, consisting essentially of

| | w/o |
|---|---|
| Carbon | 0.35–0.50 |
| Manganese | 1.0 Max. |
| Silicon | 2.0 Max. |
| Chromium | 5.8–7.0 |
| Molybdenum | 1.8–2.2 |
| Vanadium | 0.6–1.1 |

and the balance essentially Iron.

2. An alloy steel as recited in claim 1 which contains not more than about 5.8–6.2 w/o Chromium.

3. A deep air hardenable alloy steel having a high hardness capability, improved room temperature toughness when air cooled in large section sizes, good temper resistance up to 1100° F., and exceptional wear resistance, said alloy steel, in weight percent, consisting essentially of about

| | w/o |
|---|---|
| Carbon | 0.35–0.50 |
| Manganese | 1.0 Max. |
| Silicon | 2.0 Max. |
| Chromium | 5.8–6.2 |
| Molybdenum | 1.85–1.95 |
| Vanadium | 0.6–1.1 |

and the balance essentially iron.

4. An alloy steel as recited in claim 3 which contains at least about 0.42 w/o carbon.

5. An alloy steel as recited in claim 4 which contains about 0.7–0.9 w/o Vanadium.

6. A deep air hardenable alloy steel having a high hardness capability, improved room temperature toughness when air cooled in large section sizes, good temper resistance up to 1100° F., and exceptional wear resistance, said alloy steel, in weight percent, consisting essentially of

| | w/o |
|---|---|
| C | 0.42–0.5 |

-continued

| | w/o |
|---|---|
| Mn | 0.35–0.6 |
| Si | 0.8–1.2 |
| Cr | 5.8–6.2 |
| Mo | 1.85–1.95 |
| V | 0.7–0.9 |

and the balance essentially Iron.

7. An alloy as recited in claim 6 which contains about 5.95–6.05 w/o Chromium.

8. An alloy as recited in claim 7 which contains 0.42 to about 0.46 w/o Carbon.

9. An alloy as recited in claim 8 which contains 0.77–0.83 w/o Vanadium.

10. An alloy steel as recited in claim 9 which contains up to about 0.1 w/o Sulfur.

* * * * *

UNITED STATES PATENT AND TRADEMARK OFFICE

CERTIFICATE OF CORRECTION

PATENT NO. : 4,853,181

DATED : AUGUST 1, 1989

INVENTOR(S) : DAVID E. WERT and RAYMOND M. HEMPHILL

It is certified that error appears in the above-identified patent and that said Letters Patent is hereby corrected as shown below:

Title page:

Under the heading "References Cited", "U.S. Patent Documents", should include the following as the last-listed document --3,855,015 12/1974 Nemoto et al. ..... 428/683 --.

After the heading "U.S. Patent Documents" and before the heading "Other Publications", the heading -- Foreign Patent Documents -- should be inserted and under that heading the following should be listed -- 445651 4/1936 British -- and -- 541894 3/1977 U.S.S.R. --.

Column 1,

Line 31, "5 Cr" should be -- 5% Cr --.

Column 2,

Line 11, "mpurities" should be -- impurities --.

Column 3,

Line 26, "touchness" should be "toughness".

Column 6,

In "TABLE V", third line under column entitled "Avg." "143,5" should be -- 143.5 --;

In "TABLE VI", "0.2% Y.S" should be -- 0.2% Y.S. --.

UNITED STATES PATENT AND TRADEMARK OFFICE

CERTIFICATE OF CORRECTION

PATENT NO. : 4,853,181

DATED : AUGUST 1, 1989

INVENTOR(S) : DAVID E. WERT and RAYMOND M. HEMPHILL

It is certified that error appears in the above-identified patent and that said Letters Patent is hereby corrected as shown below:

Column 8,

Line 9, after "simulates" "he" should be -- the --.

Column 9,

In "TABLE X", under the column entitled "0.2% Y.S.", line 23, "5.0" should be -- 225.0 --.

Claims,

Claim 2, line 2, "5.8-6.2" should read --6.2 --.

Signed and Sealed this

Second Day of October, 1990

*Attest:*

HARRY F. MANBECK, JR.

*Attesting Officer*

*Commissioner of Patents and Trademarks*